US005331782A

United States Patent [19]

Wohlgemuth

[11] Patent Number: 5,331,782

[45] Date of Patent: Jul. 26, 1994

[54] BASEMENT ENCLOSURE

[76] Inventor: Franz F. Wohlgemuth, 3467 Broadway St., Grove City, Ohio 43123

[21] Appl. No.: 629,965

[22] Filed: Dec. 17, 1990

Related U.S. Application Data

[63] Continuation of Ser. No. 283,105, Dec. 12, 1988, abandoned.

[51] Int. Cl.[5] ..... E02D 27/00

[52] U.S. Cl. ..... 52/169.7; 52/169.14; 52/309.1

[58] Field of Search ..... 52/169.8, 169.9, 169.14, 52/299, 169.6, 169.7, 169.1, 309.1; 405/229

[56] References Cited

U.S. PATENT DOCUMENTS

| | | | |
|---|---|---|---|
| 57,022 | 8/1866 | Weed | 52/169.6 X |
| 592,190 | 10/1897 | Bond | 52/169.6 X |
| 3,172,377 | 3/1965 | Dewar | 52/169.6 X |
| 3,816,234 | 6/1974 | Winfield . | |
| 4,033,078 | 7/1977 | Prewer | 52/83 X |
| 4,226,062 | 10/1980 | Doane | 52/169.6 |
| 4,334,393 | 6/1982 | U'ren | 52/169.6 |
| 4,359,845 | 11/1982 | Harrison | 52/169.6 |
| 4,939,878 | 7/1990 | Schuhbauer | 52/169.14 |

FOREIGN PATENT DOCUMENTS

| | | | |
|---|---|---|---|
| 410584 | 4/1945 | Italy | 52/169.6 |
| 62338 | 4/1985 | Japan | 52/169.6 |
| 958636 | 9/1982 | U.S.S.R. | 52/169.6 |

*Primary Examiner*—Carl D. Friedman
*Assistant Examiner*—Lan C. Mai
*Attorney, Agent, or Firm*—John L. Gray

[57] ABSTRACT

A basement enclosure is provided with an outer shell which is constructed of a material impermeable to moisture and gas. The basement enclosure may be free standing or hung from beams which are supported by columns set on a conventional footer.

6 Claims, 2 Drawing Sheets

FIG. 1
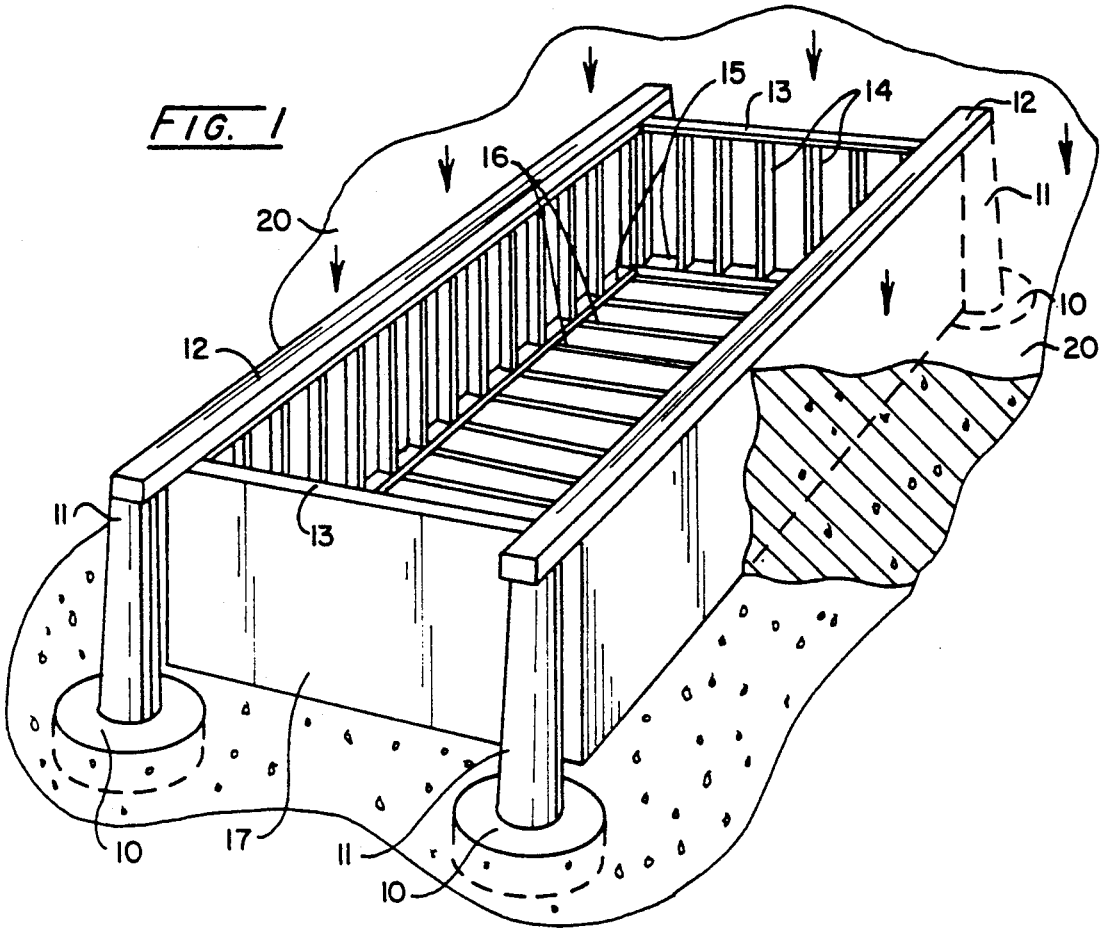
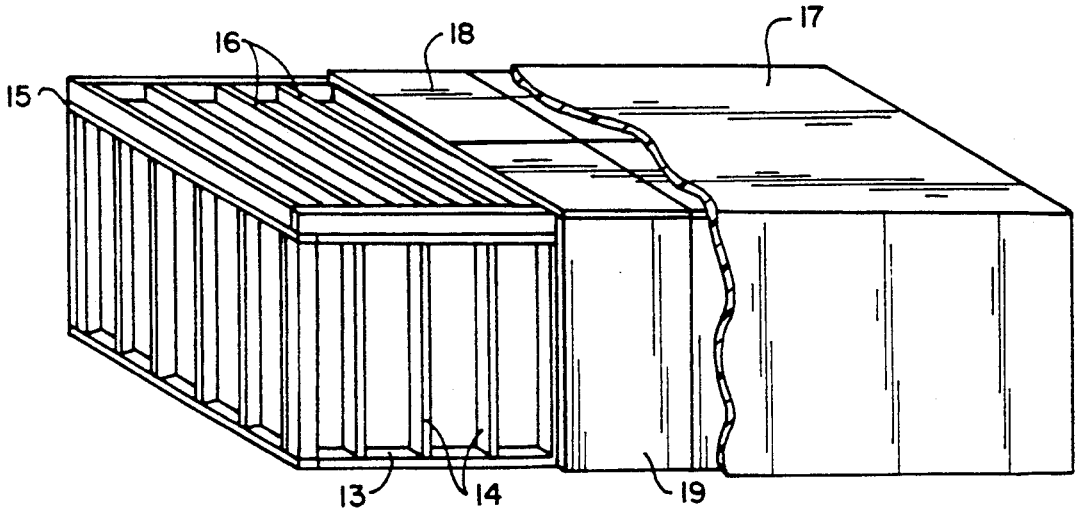
FIG. 2

BASEMENT ENCLOSURE

This application is a continuation of application Ser. No. 07/283,105 filed Dec. 12, 1988 now abandoned.

BACKGROUND OF INVENTION

Conventional basements are constructed of cast concrete or laid up cement block, or variations that include pressure treated wood panels to form the walls. The basement is usually set on a footer of poured concrete. Conventional basements do not provide a lasting barrier to penetration by ground water, radon gas, or any other objectionable fluids. Penetration of moisture through walls and floor can create dampness, flooding, and structural damage. The penetration of radon gas can cause health problems. In many cases, damage to the basement and its contents can be expensive and extensive, requiring repair or even replacement of the basement walls.

Present attempts to solve these problems include the application of sealing material to the below ground exterior walls, using a sealing material on the cracks in the floor, and installing drainage systems and sump pumps. These methods can be costly and offer no permanent solution. The concrete floor of a conventional basement oftentimes will be cracked due to the heave of underlying soil expansion when water is absorbed into the soil. Construction of basements using conventional techniques requires several days and sometimes weeks to allow for setting and curing of the concrete after each step in the construction before the next step can be made.

SUMMARY OF THE INVENTION

The present invention is a basement enclosure where the basement enclosure is constructed of a vapor and liquid impermeable material. The vapor and liquid impermeable material may be made thick enough so that it will not require any additional support. However, this is generally not economic and the preferred form of basement enclosure involves a vapor and liquid impermeable material which is internally supported by conventional joists and studs and a plywood sheathing next to the vapor and liquid impermeable material. This basement enclosure foundation can be used in locations where a high water table would make standard basements impractical or impossible. The use of this basement enclosure lowers the on-site construction costs of a building by reducing the hours of skilled labor needed by reducing the overall time required to erect a building.

The invention also can be used to create a basement under an existing building that has a faulty basement or that has only a crawl space.

The basement enclosure may be made in various sizes and shapes and may be constructed in modules that can be joined together by suitable means at the installation site to form larger basement areas.

It is therefore an object of this invention to provide a basement enclosure which will insure against the entry of ground water or objectionable gases into the basement area.

It is a further object of this invention to provide such a basement enclosure which may be assembled in a factory and transported to the site.

It is still another object of this invention to provide such a basement enclosure which may be formed at the factory in modules and which may be joined together to form a larger basement area at the installation site.

These, together with other objects and advantages of the invention will become more readily apparent to those skilled in the art when the following general statements and descriptions are read in the light of the appended drawings.

BRIEF DESCRIPTION OF THE DRAWINGS

FIG. 1 is a perspective view partly in section of the basement enclosure when hung from beams supported on columns on a conventional below ground footer.

FIG. 2 is a perspective view of the basement enclosure of the present invention with portions removed to show the construction.

DETAILED DESCRIPTION OF THE INVENTION

Figure 3:
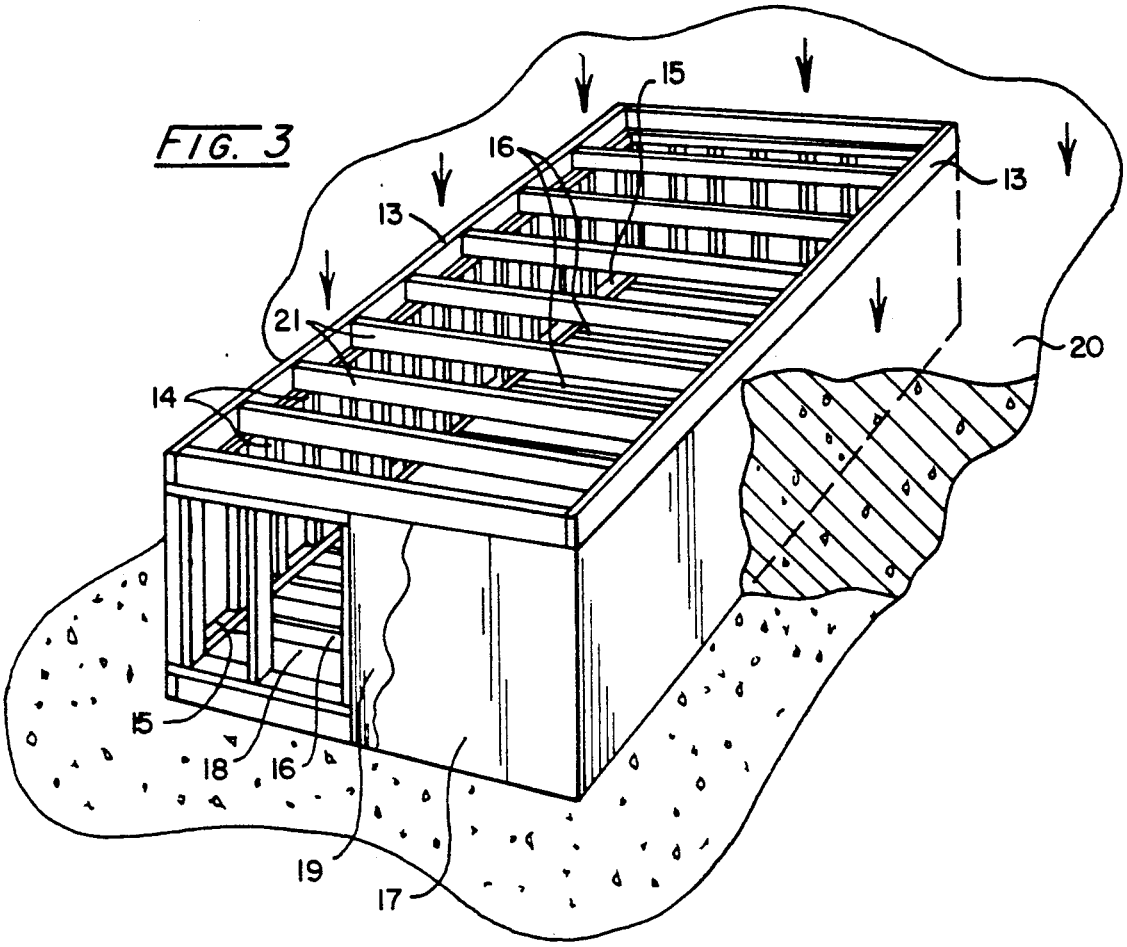
FIG. 3 is a perspective view of the basement enclosure of the present invention adapted to be placed on the bottom of a foundation excavation.

Referring now more particularly to FIG. 1, this version of the basement enclosure invention includes footers 10-10 which support columns 11-11 which in turn support beams 12-12. These beams 12-12 may be made of prestressed, reinforced concrete, steel, or any other suitable material, depending upon the span involved. Hanging from the beams 12-12 is a conventional wooden framework consisting of headers 13-13, studs 14-14, attached to sills 15-15, and floor joists 16-16. Attached and surrounding this structural enclosure is a gas and moisture impermeable shell 17 which may be made from a variety of materials, a preferred material being a fiberglass reinforced polymer. The shell 17 may be attached directly to the floor joists 16-16, studs 14-14, and sills 15-15 by adhesives or by any other means which do not affect the integrity of the shell 17 to prevent transmittal of moisture or gases.

Referring now more particularly to FIG. 2, the shell 17 is shown attached to a plywood sheeting 18 in the floor area and sidewalls 19-19 which in turn are attached by conventional means to studs 14-14, headers 13-13, and joists 16-16. The headers 13-13 are attached to the beams 12-12 by conventional methods. The unit shown in FIG. 2 may be preassembled at the factory or the shell 17 may be shipped to the site as a unit or in module form and assembled at the site with the structural elements assembled thereto and the entire unit hung from the beams 12-12.

If desired, the shell 17 may be made thick enough to provide structural support for construction of a building on it without the use of the conventional stud, joist, and plywood construction. However, for economical reasons, the conventional interior wood construction is preferred. Of course, other materials than wood may be used.

Referring now more particularly to FIG. 3, there is shown a version of the basement enclosure which may be placed directly on the bottom of the basement excavation. If desired, this unit can be placed on the leveled soil of the basement excavation, it can be placed on a concrete pad formed with conventional footers, or it can be placed on a leveled sand bed. The unit consists of headers 13-13 connected by means of studs 14-14 to sills 15-15 and floor joists 16-16. Ceiling joists 21-21 which become the floor joists of the first above ground story of the structure are provided and connected to the headers 13-13. The entire structure may be covered with plywood sheeting 18 in the floor area and sheeting 19 in the wall area with the gas and moisture impermeable shell 17 attached thereto and completely enclosing the side walls and the floor of the unit.

After the unit has been installed in the ground the area around it is back filled as is shown in section in FIGS. 1 and 3 with dirt 20 to grade level. In the case of the version of the invention shown in FIG. 1, there is space remaining between the bottom of the excavation and the bottom of the shell 17 in the final installation.

In the case of factory construction, one option is to form and cure the shell 17 on a wooden frame work, or it can be molded in a separate operation and then fastened to the wood frame, either at the factory or at the site. Any joints in the shell 17 would be sealed with a similar material thus to insure the integrity of the shell 17. For example, if a fiberglass reinforced polymer were used to form the shell 17, this could be sealed with fiberglass reinforced polymer.

In new construction of the version of the invention shown in FIG. 1, the footers 10-10 would be installed and the columns 11-11 would then be installed and the basement shell 17 and accompanying structural members would be placed in the excavation, the beams 12-12 would be attached to the columns 11-11 and the shell 17 would be firmly attached to the beams 12-12, thus completing the installation procedure. In some soil situations, the footers 10-10 may be omitted and the columns 11-11 can take the form of pylons, which are driven down into the ground. Appropriate openings can be made either at the factory or on site for sewer, water, and gas lines and appropriately sealed to prevent the entry of any moisture or gases. The structures shown are particularly adaptable to a finished basement with conventional insulation being installed between the studs 14-14 and then finished wallboard or panelling being attached to the studs.

In an existing building having a foundation, it is possible to excavate under the building, install the appropriate beams and then install the module by hanging it freely from the support beams.

It will be seen that this basement enclosure provides a continuous barrier to moisture and gases and will not be subject to most of the problems of conventional basements. In the case of the version of the invention shown in FIG. 1, the reinforced shell 17 will hang from the support beams 12-12 and thus bear no forces of compaction due to the weight of the structure. The problem of heave is eliminated because the bottom of the shell 17 is suspended above the level of the ground at the bottom of the excavated hole rather than resting on it. The problems of any settling of the foundation can be compensated with adjustments made at the point where the support beams 12-12 attach to a foundation support. Furthermore, since the basement enclosure allows for the secure anchoring of the enclosure to a foundation, potential problems of buoyancy due to high ground water are minimized.

In the case of the version of the invention showin at FIG. 3, the basement enclosure will have sufficient structural strength to support the additional construction to be placed on the top thereof, such as would be the case in a two- or three-story building, for example. This basement enclosure could be considered to be the below ground first story of a multi-story structure.

While this invention has been described in its preferred embodiment, it is to be appreciated that variations therefrom may be made without departing from the true scope and spirit of the invention.

What is claimed:

1. A basement enclosure adapted to be installed below ground level comprising a single floor in a horizontal plane, vertically extending walls attached to said floor at essentially right angles thereto around the entire periphery of said floor and thereby forming an enclosed interior zone with said zone being substantially entirely open at the top of said walls, said floor and walls together forming a rigid, self-supporting structure not requiring additional support to achieve rigidity for final proper installation and use, the top of said walls being so designed so as to be readily adapted to engage horizontal supports extending across from the top of one wall to an oppositely disposed wall, so as to receive a building to be constructed thereon and the exterior of said floor and walls having attached thereto and being completely covered with a separate outer substantially continuous contiguous shell constructed of a material impermeable to moisture and gas.

2. The basement enclosure of claim 1 wherein said outer shell is constructed of a plastic material.

3. The basement enclosure of claim 2 wherein said plastic material is a fiberglass reinforced polymer.

4. A basement enclosure adapted to be installed below ground level comprising a single floor in a horizontal plane vertically extending walls attached to said floor at essentially right angles thereto around the entire periphery of said floor and thereby forming an enclosed interior zone with said zone being substantially entirely open at the top of said walls, the top of said walls being so designed so as to be readily adapted to engage horizontal supports extending across from the top of one wall to an oppositely disposed wall, so as to receive a building to be constructed thereon and the exterior of said floor and walls having attached thereto and being completely covered with a separate outer substantially continuous contiguous shell constructed of a material impermeable to moisture and gas; and provided with foundation means engaging the ground and supported thereby, said basement enclosure hanging from and being supported by said foundation means.

5. The basement enclosure and foundation means of claim 4 wherein said foundation means includes vertical posts.

6. The basement enclosure and foundation means of claim 5 wherein said foundation means includes beams supported on said vertical posts, said basement enclosure hanging from said beams.

* * * * *